US007527544B2

(12) United States Patent
Rodriguez et al.

(10) Patent No.: US 7,527,544 B2
(45) Date of Patent: May 5, 2009

(54) SYSTEM OF USING OFFSET GAGE FOR CMP POLISHING PAD ALIGNMENT AND ADJUSTMENT

(75) Inventors: Jose Omar Rodriguez, Orlando, FL (US); Charles A. Storey, Orlando, FL (US); Andres B. Garcia, Ocoee, FL (US); Margareth Seputro, Orlando, FL (US); Frank Miceli, Orlando, FL (US)

(73) Assignee: Agere Systems Inc., Allentown, PA (US)

( * ) Notice: Subject to any disclaimer, the term of this patent is extended or adjusted under 35 U.S.C. 154(b) by 0 days.

(21) Appl. No.: 11/968,930

(22) Filed: Jan. 3, 2008

(65) Prior Publication Data

US 2008/0102738 A1 May 1, 2008

Related U.S. Application Data

(62) Division of application No. 10/953,477, filed on Sep. 29, 2004, now Pat. No. 7,338,569.

(51) Int. Cl.
*B24B 49/00* (2006.01)
*B24B 51/00* (2006.01)

(52) U.S. Cl. ..... 451/5; 451/9; 451/285

(58) Field of Classification Search ..... 156/64, 156/360, 378; 451/8, 9, 285, 286, 287, 288, 451/289, 290, 5; 700/90, 95
See application file for complete search history.

(56) References Cited

U.S. PATENT DOCUMENTS

| | | | | |
|---|---|---|---|---|
| 5,839,947 | A | 11/1998 | Kimura et al. | |
| 6,095,908 | A | 8/2000 | Torii | |
| 6,432,258 | B1 | 8/2002 | Kimura et al. | |
| 6,514,123 | B1 * | 2/2003 | Crevasse et al. | 451/28 |
| 6,682,408 | B2 | 1/2004 | Sakurai et al. | |
| 6,746,312 | B2 | 6/2004 | Torii et al. | |
| 6,783,445 | B2 | 8/2004 | Torii et al. | |

* cited by examiner

*Primary Examiner*—Timothy V Eley

(57) ABSTRACT

A method and system are provided using an offset dial gage for alignment and adjustment of a polishing pad that has been attached to a turntable of a chemical mechanical polishing (CMP) device. In a described embodiment, an offset dial gage has a surface that contacts a side of a turntable, while a sensor tip contacts the edge of a polishing pad positioned on the turntable. This provides an assessment of radial displacement of the polishing pad edge at this measurement point relative to the side of the turntable. Based on one or more such measurements, the polishing pad may be found acceptably positioned, may be trimmed, or may be replaced. The method and system reduce or eliminate the occurrence of a defect pattern found to be related to side unloading of semiconductor wafers from a CMP turntable.

10 Claims, 5 Drawing Sheets

SYSTEM OF USING OFFSET GAGE FOR CMP POLISHING PAD ALIGNMENT AND ADJUSTMENT

RELATED APPLICATIONS

This application is a divisional of U.S. Ser. No. 10/953,477 filed Sep. 29, 2004 now U.S. Pat. No. 7,338,569, which is incorporated herein in its entirety by reference.

FIELD OF THE INVENTION

The present invention is directed to integrated circuit manufacture generally, and more specifically to measurement and adjustment, as needed, of a polishing pad after installation onto a turntable of a Chemical Mechanical Polishing (CMP) device.

BACKGROUND OF THE INVENTION

In semiconductor manufacture, semiconductor wafers need to be processed to be flat both initially and at various stages of manufacture. As device features become smaller and smaller, as in the submicron size range, and as such features have increasingly tight tolerances, the importance of achieving a desired level of flatness increases. Without attaining a desired level of flatness, other efforts toward obtaining consistent functionality in submicron size chips tend to falter.

Toward achieving consistently flat wafers, specific apparatuses and methods related to the process of chemical mechanical polishing (CMP, also referred to as chemical mechanical planarization) have been developed. CMP, which combines chemical etching and mechanical abrasion to produce a flat surface, is used in wafer preparation and in wafer fabrication. A polishing pad is used during CMP. In a typical CMP operation, this pad is installed onto a rotating turntable, and one or more wafers to be planarized are disposed in abrading contact with the polishing pad surface, and a slurry is applied. The slurry typically contains a polishing agent, for instance alumina or silica, and other chemicals that etch or oxidize the wafer surface. Through such abrading contact, including with application of a slurry, the wafer surface is effectively polished and made more planar.

General and specific aspects of CMP apparatuses and processes are disclosed in U.S. Pat. No. 6,095,908, issued Aug. 1, 2000 to K. Torii, U.S. Pat. No. 6,432,258 issued Aug. 13, 2002 to Kimura and Yasuda, and U.S. Pat. No. 6,746,312 issued Jun. 8, 2004 to H. Torii et al. These references, and all other references cited herein, whether patents, patent application publications, scientific or technical publications, or other publications, are hereby incorporated by reference for their teachings. As indicated below where appropriate, certain references are incorporated with particularity for indicated teachings.

Typically both the polishing pad and the wafers are rotating in the same direction during the process. Force is applied by various means known in the art to maintain a desired pressure through the wafer(s) onto the polishing pad surface. While the method of attachment of the polishing pad to the turntable is fairly robust, such as self-sticking adhesive, the wafer(s) may be attached to their respective rotating top rings by suction or other type of light vacuum.

For certain models of CMP devices, the surface tension of the slurry between the polishing pad surface and the wafer(s) surface may be greater than the force holding the wafer(s) to their respective rotating top rings. This does not present a problem during polishing rotation, but can result in separation of wafer(s) from the top rings if the wafer(s) is/are lifted directly away from the rotating polishing pad surface. To avoid such occurrence, a common routine at the end of the CMP process is to rotate the wafer(s) to the side of the polishing pad, so that a portion (i.e., one-third or two-fifths) of the wafer surface is extending beyond, and not in contact with, the polishing pad. This is known as the "unload position."

One reference that discloses this method, and specific rotational speeds to better achieve wafer unloading, is U.S. Pat. No. 6,746,312, which is specifically incorporated by reference for these teachings. Moving wafer(s) to this unload position effectively "breaks" the surface tension sufficiently so the wafer(s) may then be lifted away (i.e., upward) from the polishing pad surface without separating from their respective rotating top rings.

However, this practice has led to observation of a specific pattern of defect on some wafers that go through this removal process. The specific pattern is comprised of a central ring of defects that corresponds to the alignment of the wafer with the edge of the polishing pad, and with a lesser frequency of defects throughout the wafer at points peripheral to this ring. The present invention identifies causative factors leading to this problem and provides a method and system to assess, quantify, and correct this problem in order to attain polished semiconductor wafers with less defects related to moving the wafers to the unload position.

BRIEF DESCRIPTION OF THE DRAWINGS

For a better understanding of the invention, reference is made to the following detailed description taken in conjunction with the accompanying drawings in which.

DETAILED DESCRIPTION OF THE INVENTION

Figure 1:
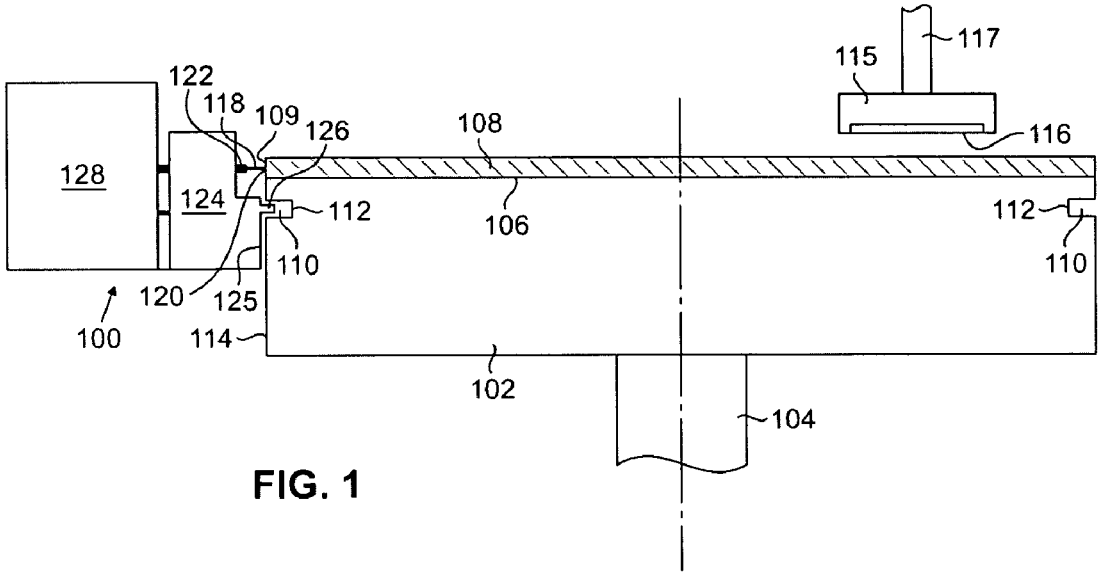
FIG. 1 provides a schematic cross-sectional side view of a CMP turntable after placement of a polishing pad, with an offset dial gage of the present invention positioned to measure the relative placement, at one perimeter point, of the polishing pad. A rotatable wafer ring also is shown in a position above the polishing pad surface.

Having identified the above-described pattern of defects, the inventors have identified a correlation between this pattern of defects and misalignment of a polishing pad on the turntable. Without being bound to a particular theory, it is believed that improper alignment between the pad and the turntable results in elevated pad sections beyond the edge of the turntable after pad reconditioning. This is because the pad reconditioning (resurfacing) applies an abrasive pad with pressure against the polishing pad, and when there is no turntable beneath a section of pad beyond the turntable (i.e., an overhanging pad section), that pad section merely deforms downward during the reconditioning process. Then, after the reconditioning process, that pad section returns to a nondeformed position, which is higher in elevation than the interior area of the now-reconditioned pad surface. This higher elevation causes the defect pattern when a wafer is in the "unload position." It also is believed that the occurrence of any burr or other physical imperfection on the peripheral pad section subject to this deflection during reconditioning exacerbates the occurrence of defects. A burr may occur when the pad edge is trimmed during or after installation.

In one broad embodiment of the present invention, a system is provided for using an offset dial gage to assess alignment of a polishing pad on a CMP turntable. In this system, for polishing semiconductor wafers, a semiconductor wafer polisher comprises a rotatable turntable, a polishing pad removably affixed to a top surface of the turntable, and a rotatable wafer ring adapted to hold a semiconductor wafer against the top surface during wafer planarization. U.S. Pat. Nos. 6,432,258 and 6,746,312, which are specifically incorporated by reference for these teachings, describe the characteristics and physical relationships of the major components of a semiconductor wafer polisher (i.e., a CMP apparatus), which include a rotatable turntable, a polishing pad removably affixed to a first (typically top) surface of the turntable, and a rotatable wafer ring (also referred to as a "guide ring" or "top ring" in these references) adapted to hold a semiconductor wafer against the polishing pad during wafer polishing.

Another component of the system is a polishing pad offset dial gage having a component (i.e., a block) having a surface adapted for positioning against an outer peripheral edge of the turntable, a sensor pin having a tip positioned to engage an outer peripheral edge of the polishing pad, and a data readout providing distance measurements as a function of displacement of the sensor pin tip from an initial position. A measurement of a linear difference between the edges (reflecting a difference in radial dimension) by the dial gage provides information as to the acceptability of polishing pad placement prior to polishing semiconductor wafers. In some embodiments, standards are established that determine actions to be taken based on the largest measured deviation of the pad edge beyond (peripheral to) the edge of the turntable top surface to which the pad is attached.

In another broad embodiment of the present invention, a method of establishing alignment of a polishing pad on a turntable comprises: bonding the polishing pad to a top surface of the turntable; detecting along a common radius a maximum difference in radial dimension between an outer peripheral edge of the polishing pad and an outer peripheral edge of the turntable; and determining a corrective action as a function of the maximum difference in radial dimension. As for the system embodiment summarized above, in some method embodiments standards are established that determine which corrective actions are to be taken based on the largest measured deviation of the pad edge beyond (peripheral to) the edge of the turntable top surface to which the pad is attached.

In both above-described broad embodiments a calibration block may be used to calibrate the device (i.e., a polishing pad offset dial gage) to a known starting value (i.e., zero) prior to taking measurements of the difference between an outer peripheral edge of the polishing pad and an outer peripheral edge of the turntable.

An exemplary embodiment is depicted in FIG. 1. In FIG. 1 a polishing pad offset dial gage 100 adapted for use in the system and method of the present invention is depicted in measuring position in relation to a turntable 102, driven by a central shaft 104, and having on its top surface 106 a polishing pad 108, the polishing pad 108 having an edge 109. A horizontal slot 110 having an inside vertical wall 112 passes around the circumference of the side 114 of the turntable 102. The alignment of the turntable edge 109 relative to the side 114 is what is being measured by the method and system of the present invention. A rotatable wafer ring 115, holding a semiconductor wafer 116, and driven by a rotating shaft 117, is shown in a position above the polishing pad surface. During polishing process (not shown in FIG. 1) the rotatable wafer ring 115 moves downward so the semiconductor wafer 116 contacts the surface of the polishing pad 108.

The offset dial gage 100 is comprised of a gage shaft 118, ending in a gage tip 120, the gage shaft 118 disposed from a gage tip housing 122 which is positioned in a gage block 124 having a measurement contact surface 125. Also emanating from the gage block 124 is a protruding horizontal tab 126 that extends distally from the plane defined by the measurement contact surface 125. Data indicating displacement of the gage tip 120 is communicated to the gage body 128, which comprises a data readout (not shown in FIG. 1), for example, an analog dial indicator or a digital LCD display.

During measurement with the polishing pad offset dial gage 100, the protruding horizontal tab 126 on the gage block 124 inserts into horizontal slot 110. The inward movement is stopped by the measurement contact surface 125 of the gage block 124 contacting the side 114 of the turntable 102. The positioning of the protruding tab 126 inside the horizontal slot 110 assures a substantial horizontal alignment of the offset dial gage 100 during measurements, thereby increasing accuracy. When the offset dial gage 100 is so positioned, the gage tip 120 is coplanar with the polishing pad 108. When the offset dial gage 100 is so positioned, the displacement of the edge 109 of polishing pad 108 (relative to side 114 of the turntable 102) is sensed by the gage tip 120. If at a particular point of measurement the edge 109 of the polishing pad 108 lies inward of the cylinder defined by the side 114 of the turntable, then the gage tip 120 extends (such as by spring or other force developed within the gage tip housing 122) to meet this inward-positioned edge 109, and a negative displacement reading is recorded. If, alternatively, at a particular point of measurement the edge 109 of the polishing pad 108 lies outward of the cylinder defined by the side 114 of the turntable, thereby extending beyond the support provided by the turntable 102, then the gage tip 120 is pushed toward gage body 128, and a positive displacement reading, also referred to as a "positive difference," is recorded.

Figure 2A:
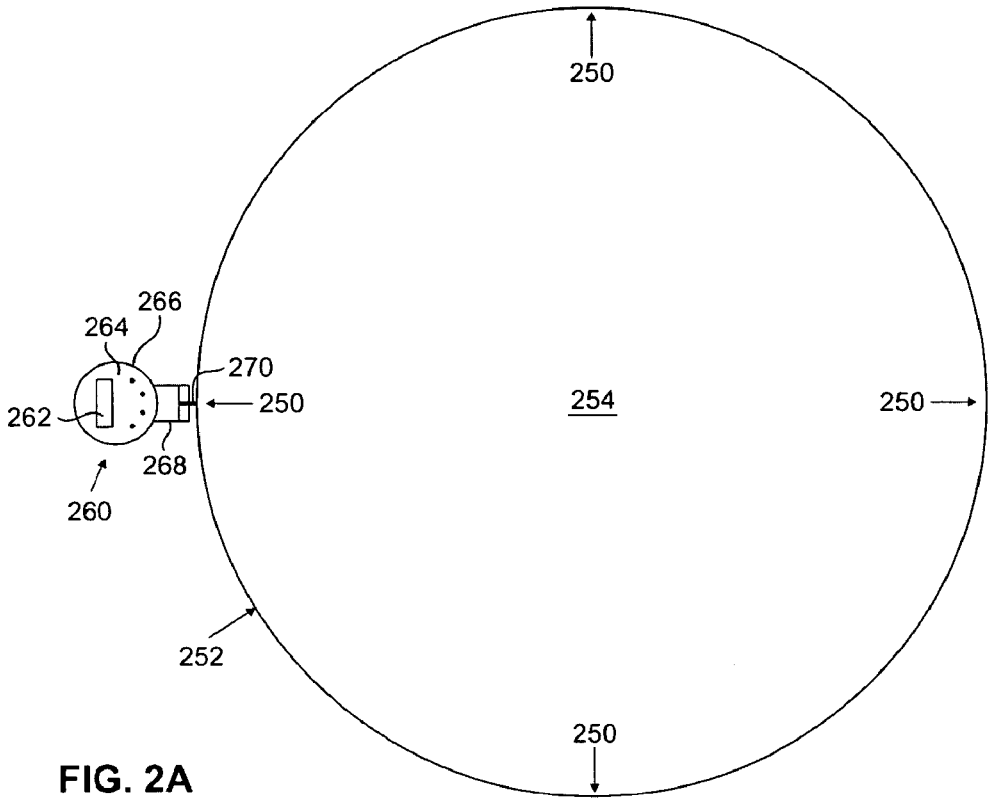
FIG. 2A provides a top view of a CMP turntable indicating a plurality of measurement points along the turntable perimeter.

Typically, more than one measurement is taken during an assessment of the positioning of a newly placed polishing pad on a CMP turntable. FIG. 2A provides a top view of a CMP turntable indicating a plurality of measurement points 250 along the turntable perimeter 252 of turntable 254. In that space is often constricted around a turntable, and various shrouds, guards, etc., (not shown in FIG. 2A) need to be removed simply to access a turntable on a CMP in order to measure the polishing pad with a polishing pad offset dial gage such as described above, the dial gage may remain in one position of the CMP apparatus (where shrouds, guards, etc. have been removed), and the turntable is rotated to bring each of measurement points 250 to the position of the dial indicator. In FIG. 2A, a dial indicator 260 is depicted, showing an LED data readout 262 on a top face 264 of a circular gage body 266. A gage block 268 also is viewable, as is the gage shaft 270.

Figure 2B:
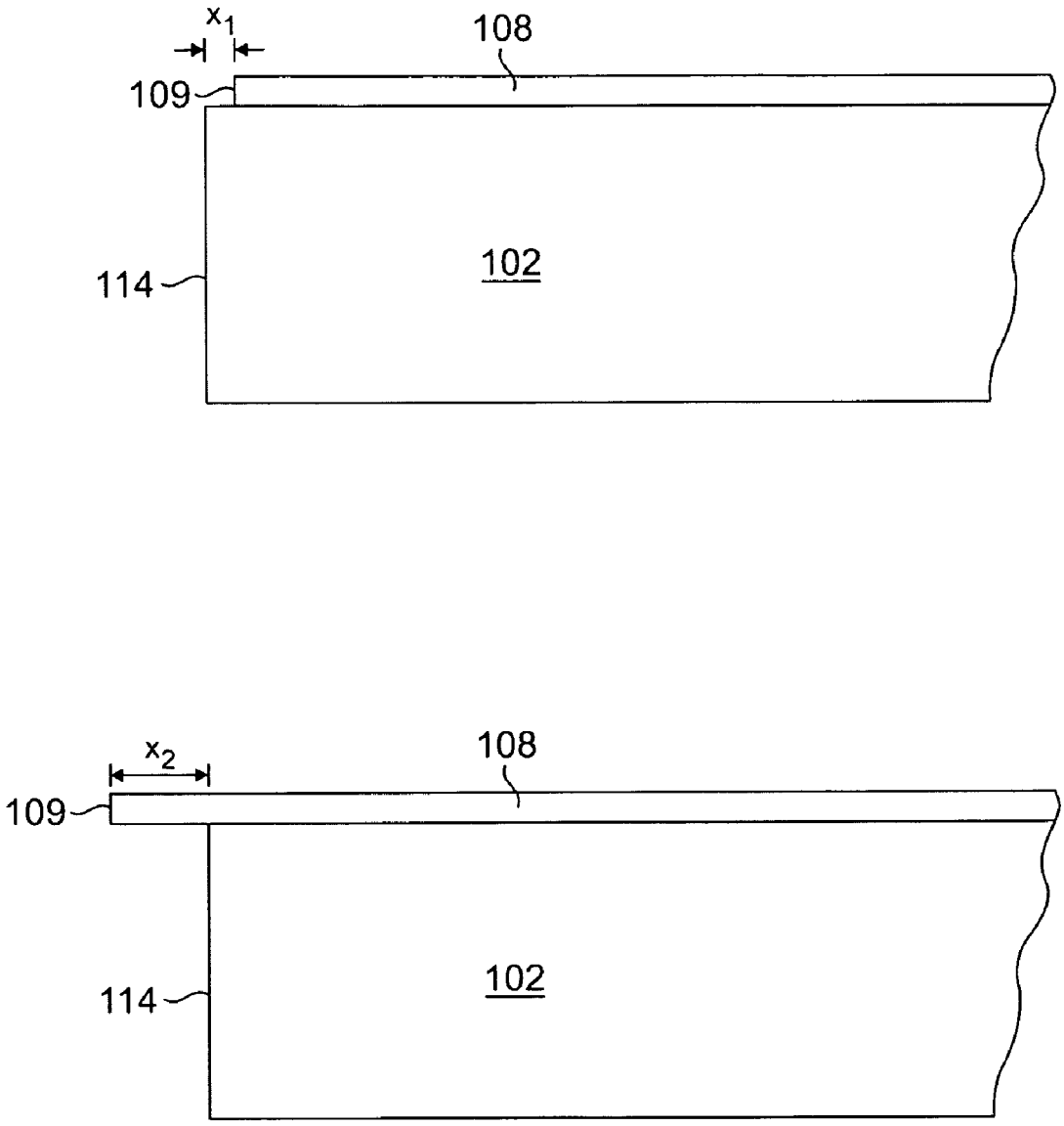
FIG. 2B provides an enlargement of a section of FIG. 1A, from a side view, depicting misalignment of the polishing pad on the turntable.

FIG. 2B provides an enlargement of a section of FIG. 1A, from a side view, and depicts two exemplary misalignments of the polishing pad on the turntable. In the top example, the end 109 is recessed relative to the turntable side 114 by a dimension (equivalent to the difference from the center of the turntable 102) designated as "$x_1$". In the bottom example, the end 109 extends beyond the turntable side 114 by a dimension designated as "$x_2$". As referred to herein, including the claims, the difference between the radial distance of end 109 and the turntable side 114 shown as "$x_2$" is a positive difference in radial dimension in that it overhangs the side 114 of turntable 102. Applicants have found that the pattern defects occur when the overhand dimension $x_2$ exceeds a first minimum dimension, typically about 1 millimeter, and such minimum appears to be constant irrespective of turntable diameter, or at least from about 20 inches to 36 inches in diameter.

As to assessment and corrective action, in some embodiments the following limits and corrective action are implemented with regard to the difference in radial dimension between an outer peripheral edge of the polishing pad and an outer peripheral edge of the turntable:

If the difference is less than a first selected value of about 1 millimeter, no corrective action is required.

If the difference is between 1 and a second selected higher value of about 3 millimeters, the overhanging edge of the polishing pad (i.e., polishing pad material extending beyond the outer peripheral edge of the turntable) is trimmed with care, with inspecting for (and removal of) any burrs caused by the trimming.

If the difference is greater than about 3 millimeters, the polishing pad is replaced.

Typically, the above criteria are applied to the highest of the values obtained from measurements taken at different measurement points along the edge of the polishing pad. Also, in other embodiments, only the positive differences in radial dimension are considered for the above, or other, assessment and corrective action regimens.

Figure 3A:
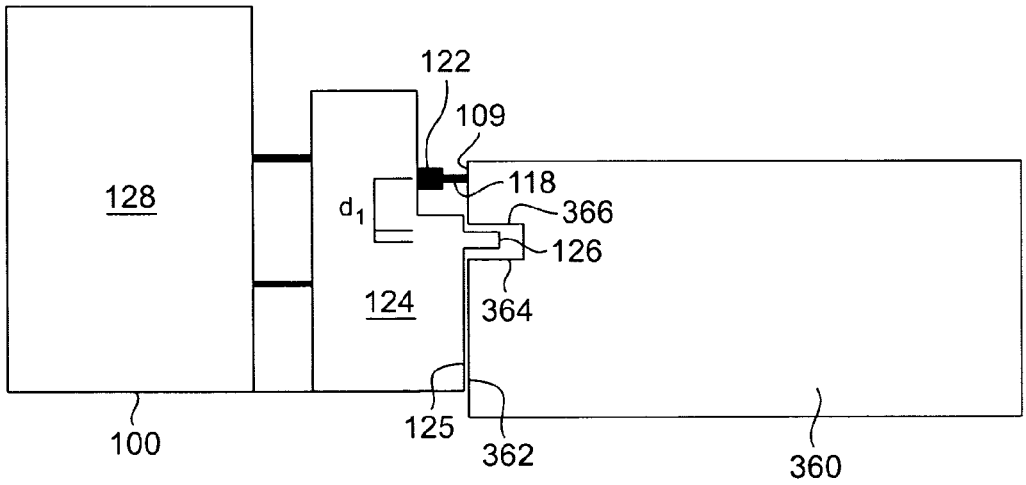
FIG. 3A provides a schematic cross-sectional side view of an offset dial gage of the present invention positioned against a calibration block during calibration.

FIG. 3A provides a schematic cross-sectional side view of the offset dial gage 100 from FIG. 1 is positioned against a calibration block 360 during calibration. The calibration block 360 comprises a face 362 in which is positioned a horizontal recess 364 into which the horizontal tab 126 can fit. The horizontal recess 364 is positioned such that a calibration of the offset dial gage 100 may be calibrated to zero by the following method:

insert horizontal tab 126 into horizontal recess 364;

press the offset dial gage 100 against the face 362 until both the sensor tip 109 and the measurement contact surface 125 contact face 362; and set a zero calibration control of the offset dial gage 100 to zero.

The zero calibration control (not shown in FIG. 3A) is a switch, a button or other control linkage that operates to set to zero the readout of the offset dial gage for the position of the sensor tip at the time the zero calibration control is activated (i.e., is set). The zero calibration control may be positioned in a any of a number of convenient locations on the offset dial gage 100.

A user doing this calibration, with experience, takes care to hold the offset dial gage 100 horizontally, and lifting the offset dial gage 100 upwards so that the upper surface of the horizontal tab 126 fully contacts the upper wall 366 of the horizontal recess 364 assures a horizontal positioning during calibration. This improves the accuracy of the calibration. After zeroing the offset dial gage is removed from the calibration block for using to assess the positioning of a polishing pad on a turntable where the turntable has the appropriately corresponding distance characteristic as the calibration block.

Figure 3B:
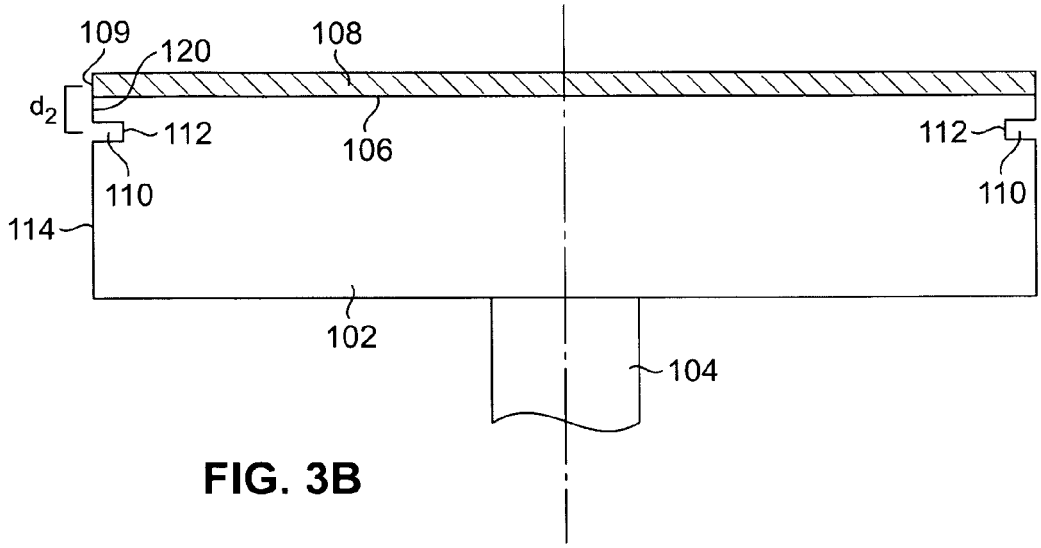
FIG. 3B provides a cut-off schematic cross-sectional side view of a CMP turntable showing a vertical distance between a horizontal slot and the polishing pad.

As to the distance characteristic, a calibration block has a range of vertical distances, designated as "$d_1$", along its vertical face 362 that includes a vertical distance "$d_2$" along the side 114 of the corresponding turntable. This distance "$d_2$", shown in FIG. 3B, which provides a cut-off schematic cross-sectional side view of CMP turntable 102, is a vertical distance between a horizontal slot and the polishing pad. Thus, the distance $d_1$ is equal to a distance between a point along the vertical opening of the horizontal slot 110 and a point along the vertical space occupied by the polishing pad when positioned atop the turntable 102. This provides for a calibration to zero that corresponds to a zero reading by the offset dial gage 100 when the latter assesses the positioning of a polishing pad 108 having an edge 109 in vertical alignment with the side 114 of the turntable 102.

Figure 3C:
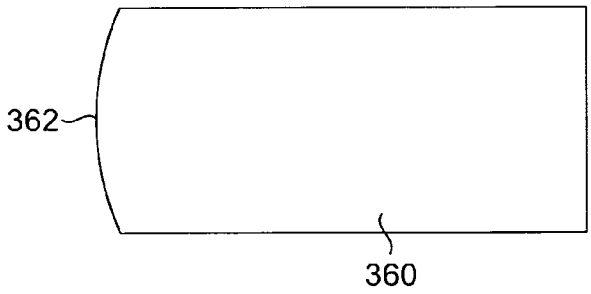
FIG. 3C provides a top view of the calibration block

FIG. 3C provides a top view of the calibration block. The shape of the face 362 is arcuate, corresponding to the radius of the turntable. In other embodiments the shape may be linear, or another desired shape.

Having described the use of an offset dial gage that has a protruding horizontal tab for insertion into a horizontal slot of a turntable, and the use of a corresponding calibration block that has a horizontal recess, it is appreciated that embodiments of the present system and method may utilize an offset dial gage that does not have that tab. Likewise, in such embodiments a corresponding turntable may not have a horizontal tab, and a corresponding calibration block may not have a horizontal recess. When practicing such method and system embodiments, other alignment and/or leveling devices/approaches may be incorporated, as are known to those skilled in the art, or, alternatively, greater care may be taken to visually align to that accurate readings are attained.

While the preferred embodiments of the present invention have been shown and described herein in the present context, such embodiments are provided by way of example only, and not of limitation. Numerous variations, changes and substitutions will occur to those of skilled in the art without departing from the invention herein. For example, the present invention need not be limited to best mode disclosed herein, since other applications can equally benefit from the teachings of the present invention. Accordingly, it is intended that the invention be limited only by the spirit and scope of the appended claims.

What is claimed is:

1. A system for polishing semiconductor wafers comprising:

a. a semiconductor wafer polisher comprising a rotatable turntable, a polishing pad removably affixed to a first surface of the turntable, and a rotatable wafer ring adapted to hold a semiconductor wafer against the polishing pad during wafer polishing;

b. a polishing pad offset dial gage having a frame having a surface adapted for positioning against an outer peripheral edge of the turntable, a sensor pin having a free tip positioned to engage an outer peripheral edge of the polishing pad, and a data readout providing distance measurements as a function of radial displacement of the sensor pin tip from an initial position;

wherein measurement by the dial gage of the radial displacement between the polishing pad peripheral edge and the turntable peripheral edge provides information as to the acceptability of polishing pad placement prior to polishing semiconductor wafers.

2. The system of claim 1 wherein the offset dial gage additionally comprises a horizontal tab extending from the surface, the tab adapted to enter a horizontal slot along the edge of the turntable.

3. The system of claim 2, additionally comprising a calibration block comprising a substantially planar face comprising a first position against which the sensor pin tip is positioned, the first position spaced a distance away from a recess adapted to receive the horizontal tab, the distance equal to a vertical distance between the polishing pad edge and the horizontal slot.

4. The system of claim 1, wherein the dial gage is an offset dial gage that comprises a gage body having a data readout, a zero calibration control, a gage block having a measurement contact surface, a gage shaft ending with a gage tip adjustable to align with the measurement contact surface, and a horizontal tab that protrudes distally from the measurement contact surface.

5. The system of claim 1, wherein the dial gage is an offset dial gage having a gage body.

6. The system of claim 5, wherein the dial gage further include a data readout.

7. The system of claim 5, wherein the dial gage further includes a zero calibration control.

8. The system of claim 5, wherein the dial gage further includes a gage block having a measurement contact surface.

9. The system of claim 5 wherein the dial gage further includes a gage shaft ending with a gage tip adjustable to align with the measurement contact surface.

10. The system of claim 5, wherein the dial gage further includes a horizontal tab that protrudes distally from the measurement contact surface.

* * * * *